US005364553A

United States Patent [19]

Cao

[11] Patent Number: 5,364,553

[45] Date of Patent: Nov. 15, 1994

[54] STABILIZED BUILT AQUEOUS LIQUID SOFTERGENT COMPOSITIONS

[75] Inventor: Hoai C. Cao, Liege,

[73] Assignee: Colgate-Palmolive Company, New York, N.Y.

[21] Appl. No.: 106,972

[22] Filed: Aug. 16, 1993

Related U.S. Application Data

[63] Continuation of Ser. No. 915,210, Jul. 20, 1992, abandoned, which is a continuation-in-part of Ser. No. 684,149, Apr. 12, 1994, Pat. No. 5,221,495, which is a continuation of Ser. No. 509,549, Apr. 13, 1990, abandoned.

[51] Int. Cl.[5] ..... C11D 3/386; C11D 3/04; C11D 3/12; C11D 3/16

[52] U.S. Cl. ..... 252/174.12; 252/135; 252/174.19; 252/174.21; 252/174.25; 252/551; 252/DIG. 12; 252/DIG. 14

[58] Field of Search ..... 252/174.12, DIG. 12, 252/174.19, 135, DIG. 14

[56] References Cited

U.S. PATENT DOCUMENTS

| | | | |
|---|---|---|---|
| 4,111,855 | 9/1978 | Barrat et al. | 252/545 |
| 4,287,082 | 9/1981 | Tolfo et al. | 252/174.12 |
| 4,305,837 | 12/1981 | Kaminsky et al. | 252/174.12 |
| 4,318,818 | 3/1982 | Letton et al. | 252/174.12 |
| 4,436,637 | 3/1984 | Ramachandran et al. | 252/8.7 |
| 4,469,605 | 9/1984 | Ramachandran et al. | 252/8.7 |
| 4,507,219 | 3/1985 | Hughes | 252/118 |
| 4,529,525 | 7/1985 | Dormal et al. | 252/132 |
| 4,532,064 | 7/1985 | Boskamp | 252/105 |
| 4,537,706 | 8/1985 | Severson, Jr. | 252/545 |
| 4,537,707 | 8/1985 | Severson, Jr. | 252/545 |
| 4,618,446 | 10/1986 | Haslop et al. | 252/135 |
| 4,761,240 | 8/1988 | Rothanvibhata et al. | 252/8.7 |
| 4,842,758 | 6/1989 | Crutzen et al. | 252/8.7 |
| 4,842,769 | 6/1989 | Shulman et al. | 252/8.6 |
| 4,900,475 | 2/1990 | Ramachandran et al. | 252/532 |
| 5,017,296 | 5/1991 | Nedonchelle | 252/8.6 |
| 5,019,292 | 5/1991 | Baeck et al. | 252/135 |
| 5,030,378 | 9/1991 | Venegas | 252/174.12 |
| 5,124,066 | 6/1992 | Russell | 252/174.12 |
| 5,156,761 | 10/1992 | Aaslyng et al. | 252/174.12 |

*Primary Examiner*—Paul Lieberman
*Assistant Examiner*—A. Hertzog
*Attorney, Agent, or Firm*—Bernard Lieberman; Robert C. Sullivan

[57] ABSTRACT

The preferred "softergent" compositions include a clay softener, a mixture of anionic and nonionic surfactants, and detergent builder(s). The detergent builder is preferably a crystalline aluminosilicate zeolite. Stabilization is achieved using an antiflocculating structurant polymer, such as low molecular weight polyacrylic acid. The anionic surfactant is preferably an ethoxylated alkyl sulfate. Enzymes and enzyme stabilizers are also included in preferred compositions.

9 Claims, 6 Drawing Sheets

STABILIZED BUILT AQUEOUS LIQUID SOFTERGENT COMPOSITIONS

This application is a continuation division, of application Ser. No. 7/925,210, filed Jul. 20, 1992, now abandoned, which is a continuation-in-part of my prior copending application Ser. No. 07/684,149, filed Apr. 12, 1991, now U.S. Pat. No. 5,221,495, which is in turn a continuation of application Ser. No. 07/509,549, filed Apr. 13, 1990, now abandoned.

This invention relates to stable, built, aqueous liquid detergent-softening compositions suitable for laundry formulations. More particularly, the invention relates to aqueous clay softener containing liquid detergent compositions which contain one or more detergent builders and which are characterized by being physically stable, homogeneous liquid compositions.

The formulation of stabilized liquid detergent compositions has been the focus of much attention in the prior art. The desirability of incorporating high solids levels into aqueous detergent compositions is primarily due to the effectiveness of various water insoluble or water dispersible additives, such as clay softeners.

In the case of liquid detergent compositions containing a builder, the problem of enzyme instability is also a problem. Primarily, detergent builders have a destabilizing effect on enzymes, even in compositions containing enzyme stabilizers which are otherwise effective in unbuilt formulations. Moreover, the incorporation of a builder into a liquid detergent composition poses an additional problem, namely, the ability to form a stable single-phase composition; the solubility of sodium tripolyphosphate, for example, being relatively limited in aqueous compositions, and especially in the presence of anionic and nonionic detergents.

In our commonly assigned copending application Ser. No. 07/255,817 filed Oct. 7, 1988, now abandoned, titled HEAVY DUTY FABRIC SOFTENING LAUNDRY DETERGENT COMPOSITION, the disclosure of which is incorporated herein in its entirety by reference, a highly advantageous "softergent" liquid composition based on a combination of anionic and nonionic surfactants and a certain type of amphoteric surfactant, inorganic builder, bentonite and water is disclosed. These compositions may, and preferably do, also include enzyme(s) and enzyme stabilization system. The enzyme stabilizer system includes 0.5 to 5% of a mixture of dibasic acid of 4 to 6 carbon atoms each, 1 to 3% of boric acid and 0.1 to 0.5% of a source of calcium ion.

In our prior copending application Ser. No. 07/684,149, filed Apr. 12, 1991, now U.S. Pat. No. 5,221,495, the entire disclosure of which is incorporated herein by reference thereto, an improved enzyme stabilization system based on (i) a boron compound, e.g. boric acid, boric oxide, borax; (ii) hydroxycarboxylic acid having from 4 to 8 carbon atoms, 2 or 3 carboxyl groups, and 1 to 4 hydroxyl groups, e.g. citric acid; and (ii) a water-soluble calcium salt, was described. This enzyme stabilization system provides improved enzyme stability of both protease and amylase enzymes, even in the presence of large amounts of builder, and even when exposed to large temperature fluctuations.

While the aqueous built detergent compositions disclosed in our prior application Ser. No. 684,149, now U.S. Pat. No. 5,221,495, exhibited adequate stability over many conditions, still further improvements in stability, with or without enzymes and enzyme stabilizers, would be considered highly beneficial, especially at high solids loading levels, and particularly in the case of "softergent" compositions. As referred to herein "softergent" compositions are intended to include those compositions which in addition to surface active detergent components, also include fabric softening additives, and particularly, the water insoluble clay softening agents which are well known in the art.

There have been numerous efforts to stabilize suspended solids in various types of aqueous or non-aqueous liquid systems, including, of course, built liquid laundry detergent compositions.

Recently an attempt to provide an explanation and general theory of stabilization of such aqueous liquid built detergent compositions was proposed in U.S. Pat. No. 4,618,446, dated Oct. 21, 1986, to Haslop, et al. According to this patent, patentees discovered that when Active Ingredients (i.e., surface active agents), dissolved Electrolyte and water are present in certain proportions, which depend upon the particular active ingredients and electrolytes, a Stable Spherulitic Composition is obtained which is capable of suspending solid particles such as builder. Stabilization by surfactant in a spherulitic phase is contrasted to stabilization by a lamellar phase. More specifically, this patent discloses pourable, fluid detergent composition including water, surfactant, having a weight ratio of surfactant to water such that, when an anhydrous surfactant desolubilizing electrolyte salt is progressively dissolved in an aqueous micellar solution of the surfactant having said weight ratio, the electrical conductivity of the solution passes through a "first conductivity minimum" at which the mixture is stable and turbid; builder in a total weight ratio of builder to surfactant of at least 1.5 to 1; and a dissolved surfactant disolubilizing electrolyte, in a total amount, including any dissolved portion of the builder, corresponding to the trough in the graph of conductivity of the composition against the concentration of electrolyte therein, which contains the "first conductivity minimum," the amount being between the minimum and maximum amounts at which the composition is stable (i.e., no layer containing more than 2% of the total volume separates from the bulk of the composition within 3 months under normal gravity and at room temperature, unless another temperature is stated) at room temperature and at a temperature below 5° C.

On the other hand, this patent also makes reference to prior proposals of compositions in which the surfactant forms a network structure of a lamellar phase, separable from the aqueous phase by centrifuging at 25° C. for 17 hours at 800 G, which forms a gel structure capable of supporting suspended particles of solid builder. While described as capable of providing more cost effective soil removing agents then the best laundry powders, such lamellar compositions are noted to have a mobility lower than desirable for some purposes.

In contrast to the above described spherulitic and lamellar phase stabilization systems, the present invention is based on the discovery that a pourable fluid built detergent composition can be made stable against phase separation, substantially, as defined in the aforementioned Haslop, et al. patent, without utilizing an amount of surfactant-desolubilizing electrolyte corresponding to the trough in the graph of conductivity of the composition plotted against the concentration of electrolyte therein, and which is neither a spherulitic system nor a lamellar system.

The compositions of this invention can, therefore, be contrasted to the stable compositions of Haslop, et al. and to the lamellar phase systems as described therein. The invention compositions are able to maintain their stability notwithstanding the presence of high solids loading levels, not only of suspended detergent builders, but also of suspended clay particles which are effective fabric softening agents.

In fact, it has been discovered that contrary to any expectation and suggestions of the prior art, the high clay content payload of the present compositions is important for stabilization. On the other hand, however, the preferred high clay content formulations often develop viscosities which for some purposes or in view of end use customer expectations are unduly high. The present inventors have discovered that these high viscosities are the result of flocculation of the suspended clay particles, although such flocculation does not result in phase separation. The flocculation phenomenon is avoided in accordance with this invention by incorporation in the formulation of a small amount of a polymeric dispersing agent. While such polymeric dispersing agents may normally be considered to provide a thickening function, it has, surprisingly, been found that the added polymeric dispersing agent results in substantially lower viscosity, presumably by preventing flocculation of the suspended clay particles (and other suspended particles, e.g., builder, etc.).

SUMMARY OF THE INVENTION

The invention provides a stable, free-flowing aqueous liquid built fabric cleaning and softening composition which contains an anionic surface active detergent, clay fabric softener, non-phosphate detergent builder, and antiflocculating structurant polymeric dispersing agent. The anionic surfactant is present in an amount to provide effective cleaning performance without interacting with any enzyme which may be, and preferably is, present in the composition. At least 50% by weight of the total surfactant present in the composition is a C8–C20 alkyl ethoxysulfate with from 1 to 11 moles ethoxy groups per mole of alkyl sulfate. The clay fabric softener and non-phosphate builder are present in effective amounts such as from about 0.5 to about 20 percent and from about 5 to about 30 percent, respectively.

The non-phosphate builder is preferably a zeolite builder, such as zeolite A. The polymeric dispersing agent is preferably homopolymer or copolymer of acrylic acid or derivative thereof.

In a preferred embodiment the inventive composition includes the following ingredients in the recited broad, intermediate and preferred ranges, in percent by weight:

| Ingredient | amount (weight %) | | |
|---|---|---|---|
| | Broad | Intermediate | Preferred |
| AEOS | 3 to 30 | 5 to 25 | 5 to 15 |
| Zeolite | 5 to 30 | 8 to 25 | 12 to 20 |
| Clay | 0.5 to 20 | 3 to 18 | 5 to 12 |
| Polymeric dispersant | 0.1 to 5 | 0.8 to 2 | 0.8 to 1.5 |
| Enzyme | 0 or 0.01 to 5 | 0 or 0.05 to 4 | 0 or 0.1 to 1 |
| Aqueous liquid carrier | | balance to 100% | |

In an especially preferred embodiment the invention composition includes a mixture of the alkylethoxysulfate anionic surfactant with a nonionic surface active agent at a ratio of anionic to nonionic in the range of from about 1:4 to about 10:1. Furthermore, the total amount of surfactant is preferably in the range of from about 5 to 30% by weight of the composition.

In a preferred embodiment of the invention, a built enzyme-containing aqueous liquid softergent composition includes (A) from about 5 to about 30%, by weight, of a mixture of (a) $C_{10}$–$C_{12}$ alkyl polyethoxy (2 to 7 moles) sulfate anionic surface active detergent compound and (b) nonionic surface active detergent compound at an (a):(b) ratio, by weight, of from about 1:4 to about 10:1; (B) from about 5 to about 30%, by weight, of at least one zeolite detergency builder; (C) from about 0.1 to about 3%, by weight, of a protease, amylase, or mixed protease-amylase enzyme system; (D) an enzyme stabilizing effective amount of an enzyme stabilization system; (E) from about 0.5 to about 20%, by weight, of a clay softening agent; and (F) water, and optionally perfume and other adjuvants.

In accordance with the process of the invention, laundering of stained and/or soiled materials is affected by contacting such materials with an aqueous solution of the above-defined liquid detergent compositions.

Figure 1:
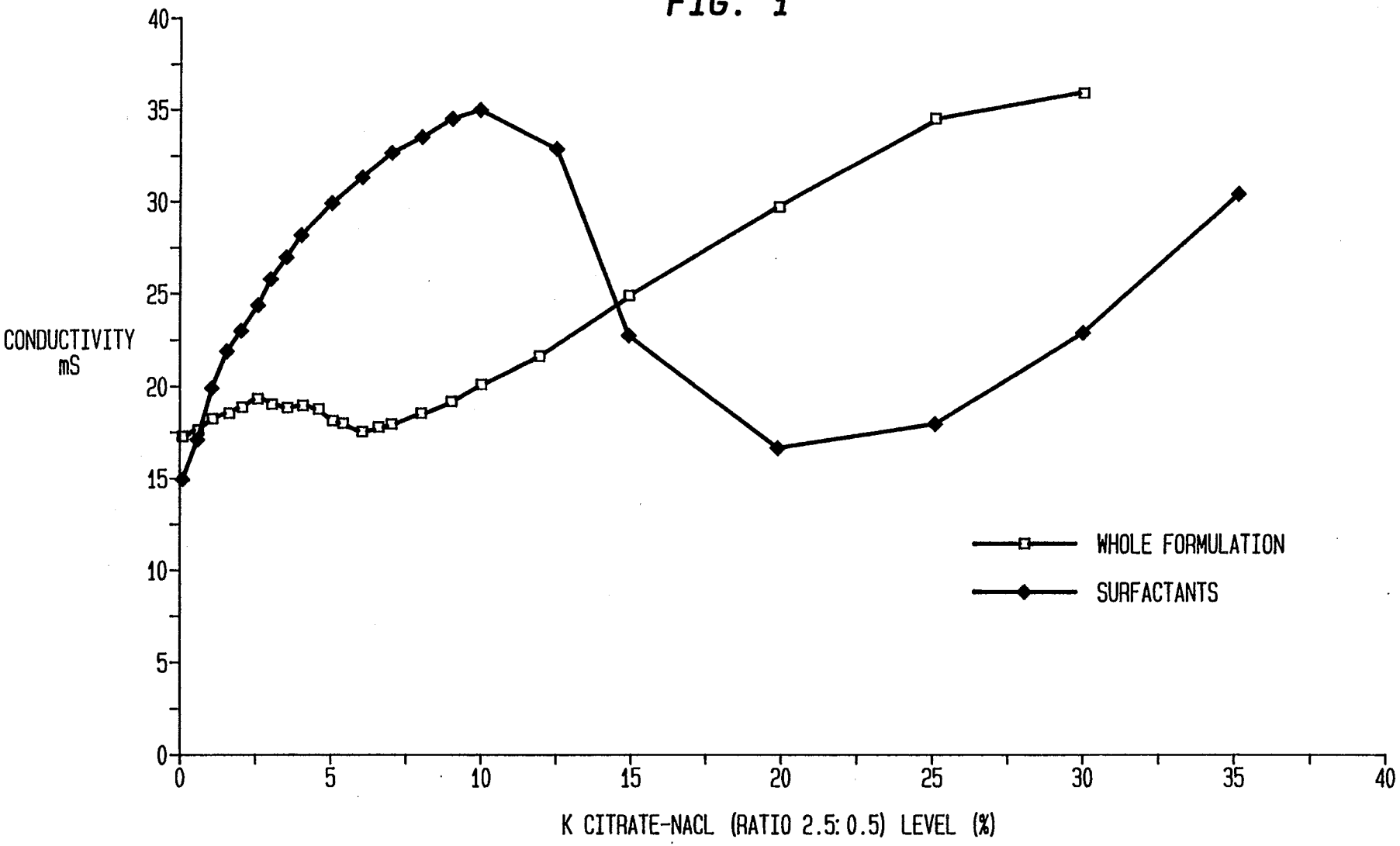
FIGS. 1–5 are conductivity curves for compositions with 0%, 1%, 2%, 2.5% and 3%, respectively of linear alkyl benzene sulfonate co-anionic surfactant as a function of electrolytes level, for the whole composition (□) or surfactants (•).
Figure 2:
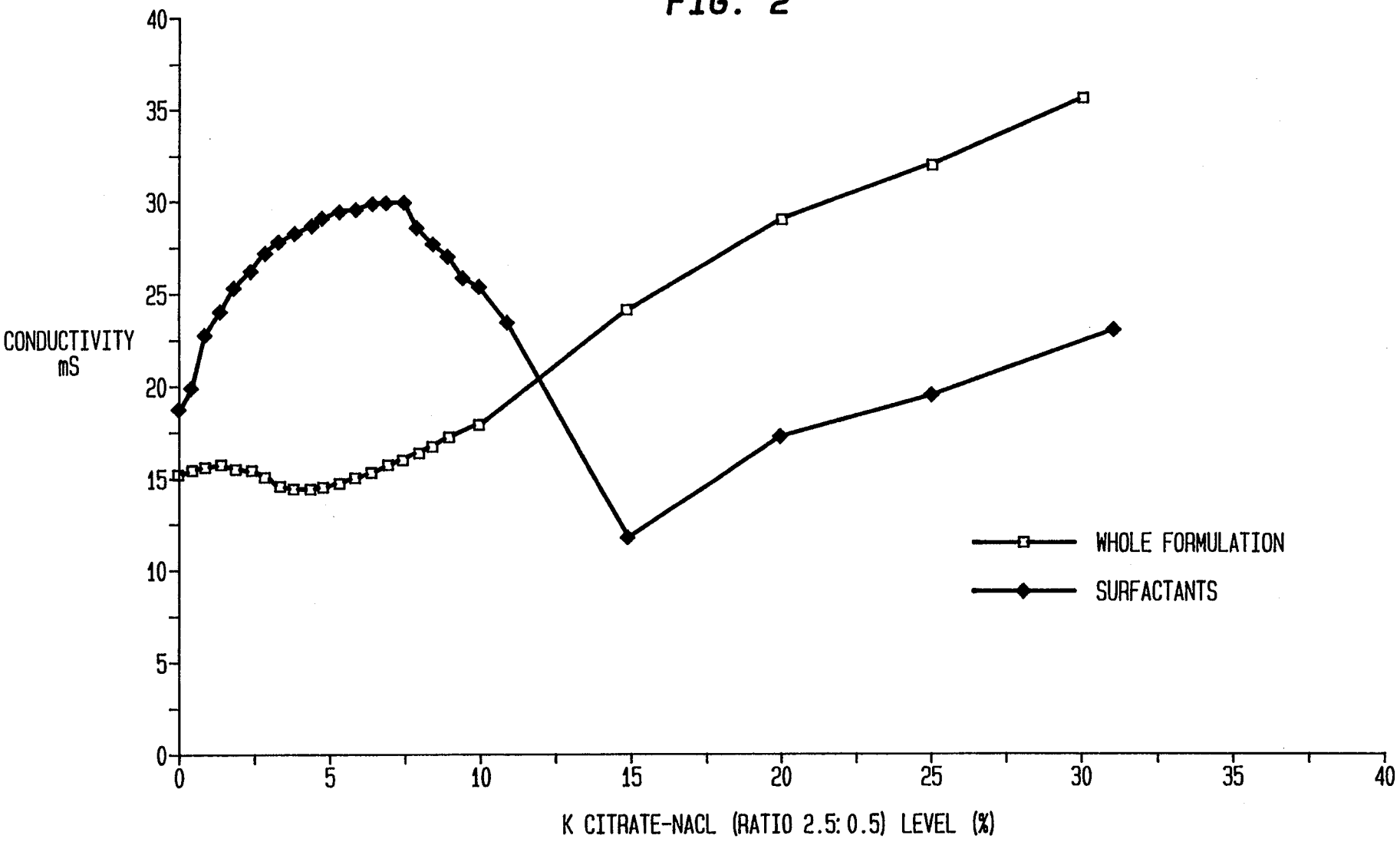
Figure 3:
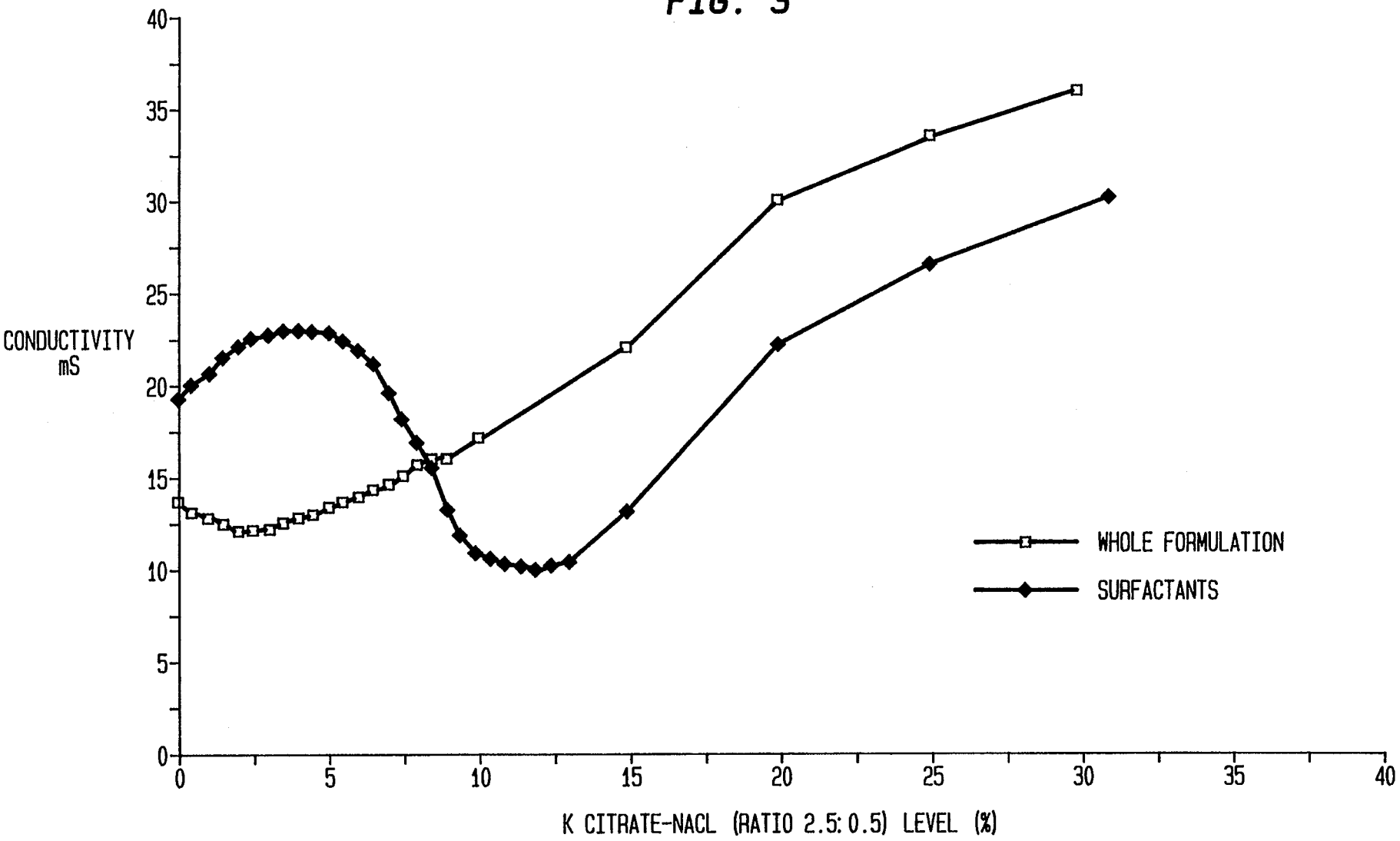
Figure 4:
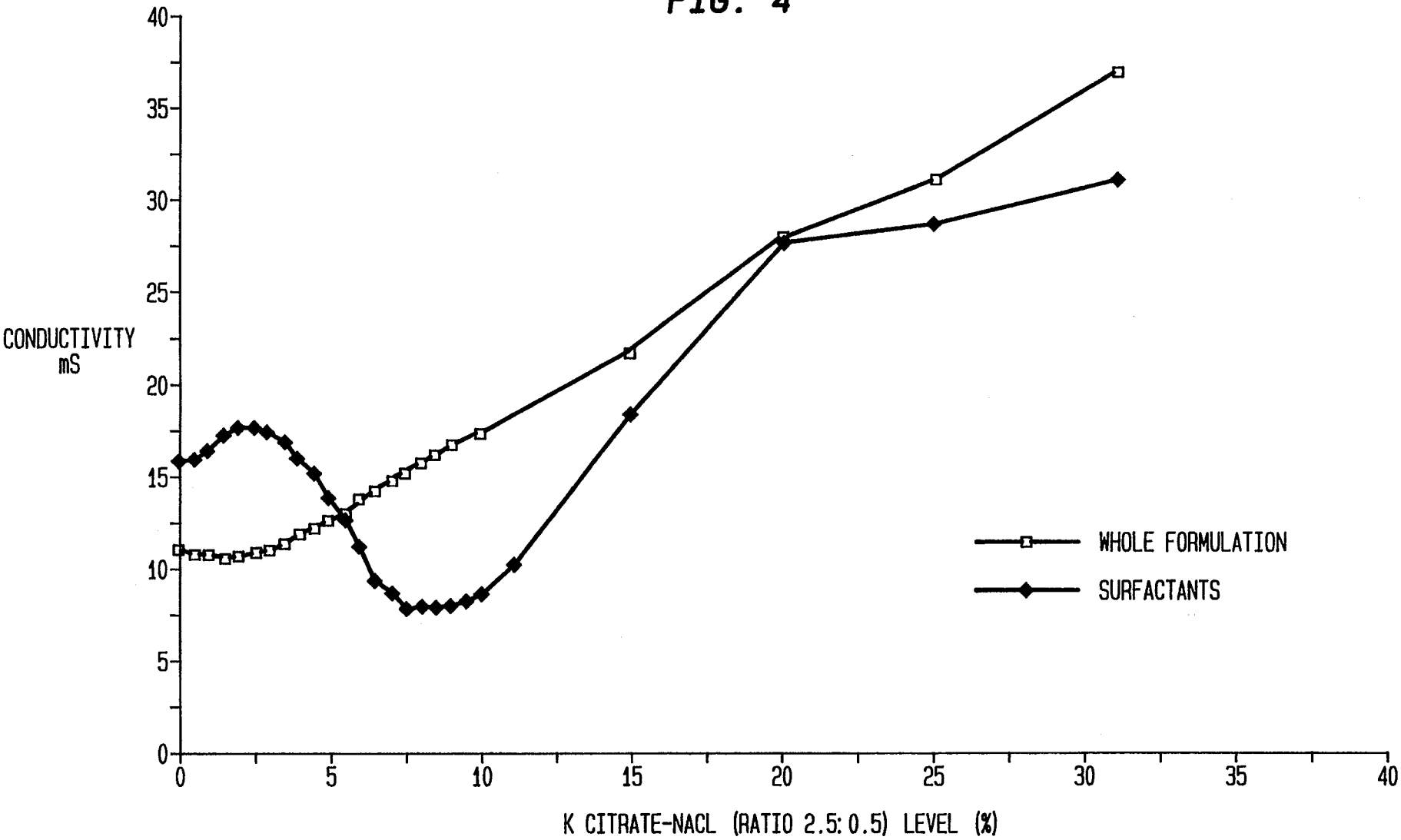

The described liquid detergent is a commercially acceptable heavy duty laundry detergent, capable of satisfactorily cleaning and softening laundry items containing both oily and particulate soils. Additionally, the described compositions may be employed for the pretreatment of badly soiled areas, such as collars and cuffs, of items to be laundered.

The present invention is a stable and pourable aqueous laundry detergent composition containing therein suspended zeolite builder and clay softener in an aqueous suspension having a visco-elastic network structure provided by a low molecular weight polymeric dispersing agent which is a non-cross-linked polymer of a carboxylic acid or derivative thereof.

Accordingly, the present invention provides a stable, free-flowing, easily pourable, liquid fabric treating composition in the form of an aqueous viscoelastic suspension comprising, in an aqueous media, anionic surface active and a viscosity stabilizing effective amount of a polymeric dispersing agent, said dispersing agent comprising a low molecular weight, non-cross-linked polymer of a carboxylic acid or derivative thereof, and said viscosity stabilizing effective amount forming a viscoelastic structure in which suspended solid clay and non-phosphate builder particles are maintained in the suspended phase due to repulsive forces between the suspended particles and the polymeric dispersing agent, and wherein the composition includes at least 15 percent by weight of suspended solid particles.

In a preferred embodiment the composition also includes one or more enzymes to assist in soil removal and, preferably, an enzyme stabilization system, to maintain the long-term effectiveness of the enzymes, in the otherwise highly stable (against phase separation or solid settling or change in viscosity) composition.

DETAILED DESCRIPTION OF THE INVENTION

I. Surface Active Detergent Compounds

The preferred detergents for use in the present liquid compositions are the synthetic anionic detergent compounds, and particularly alkyl polyethoxy sulfate. Other water soluble anionic detergent compound, such as higher alkylbenzene sulfonates may also be present in the instant formulas, such as potassium salts and in some instances the ammonium or alkanolamine salts. The alkylbenzene sulfonate when present is one wherein the higher alkyl is of 12 to 15 carbon atoms, preferable 12 to 13 carbon atoms. The alkyl polyethoxy sulfate, which also may be referred to as a sulfated polyethoxylated higher linear alcohol or the sulfated condensation product of a higher fatty alcohol and ethylene oxide or polyethoxylene glycol, is one wherein the alkyl is of 10 to 18 carbon atoms, preferably 12 to 15 carbon atoms, e.g. about 12 to 13 carbon atoms, and which includes 1 or 2 or 3 to 11 ethylene oxide groups, preferably 2 to 7, more preferably 2 to 5 and most preferably 3, or about 3 ethylene oxide groups on average. Mixtures of the alkyl polyethoxy sulfate and alkylbenzene sulfonate are often advantageous and can be used at a ratio of alkylbenzene sulfonate to polyethoxy sulfate in the detergent mixture of from about 1:6 to 6:1 and most preferably from about 1:4 to 4:1, by weight.

In suitable circumstances other anionic detergents, such as fatty alcohol sulfates, paraffin sulfonates, olefin sulfonates, monoglyceride sulfates, sarcosinates and similarly functioning detergents, preferably as the alkali metal, e.g. sodium salts, can be present, sometimes in partial replacement of the previously mentioned synthetic organic detergents but usually, if present, in addition to such detergents. Normally, the supplementing detergents will be sulfated or sulfonated products (usually as the sodium salts) and will contain long chain (e.g. 8 to 20 carbon atoms) linear or fatty alkyl groups.

In addition to any supplementing anionic synthetic organic detergents, there also may be present nonionic and amphoteric materials, like the Neodols® sold by Shell Chemical Company, which are condensation products of ethylene oxide (usually from 2 to 7 moles, e.g., about 6 moles) and higher fatty alcohols, e.g. Neodol® 23-6.5, which is a condensation product of a higher fatty alcohol of about 12 to 13 carbon atoms with about 6.5 moles, on average, of ethylene oxide. Illustrations of the various detergents and classes of detergents mentioned may be found in the text *Surface Active Agents*, Vol. II, by Schwartz, Perry and Berch (Interscience Publishers, 1958), the descriptions of which are incorporated herein by reference.

The nonionic detergents also include the polyethylene oxide condensate of 1 mole of alkyl phenol containing in the alkyl group from about 6 to 12 carbon atoms in a straight or branched chain configuration with about 5 to 30 moles of ethylene oxide, for example, nonyl phenol condensed with 9 moles of ethylene oxide; dodecyl phenol condensed with 15 moles of ethylene oxide; and dinonyl phenol condensed with 15 moles of ethylene oxide. Condensation products of the corresponding alkyl thiophenols with 5 to 30 moles of ethylene oxide are also suitable.

Of the nonionic surfactants, those of the ethoxylated and mixed ethoxylated-propyloxylated fatty alcohol type are preferred. Examples of preferred nonionic surfactants include the condensation product of coconut fatty alcohol with about 6 moles of ethylene oxide per mole of coconut fatty alcohol; the condensation product of tallow fatty alcohol with about 11 moles of ethylene oxide per mole of tallow fatty alcohol; the condensation product of a secondary fatty alcohol containing about 11-15 carbon atoms with about 9 moles of ethylene oxide per mole of fatty alcohol and condensation products of more or less branched primary alcohols, whose branching is predominantly 2-methyl, with from about 4 to 12 moles of ethylene oxide.

Other useful nonionics are represented by the commercially well-known class of nonionics which are the reaction product of a higher linear alcohol and a mixture of ethylene and propylene oxides, containing a mixed chain of ethylene oxide and propylene oxide, terminated by a hydroxyl group. Examples include the nonionics such as a $C_{13}$-$C_{15}$ fatty alcohol condensed with 6 moles ethylene oxide and 3 moles propylene oxide, etc.

Generally, the mixed ethylene oxide-propylene oxide fatty alcohol condensation products represented by the general formula $$RO(C_3H_6O)p(C_2H_4O)qH,$$

wherein R is a hydrocarbyl group, such as straight or branched, primary or secondary aliphatic hydrocarbon, preferably alkyl or alkenyl, especially preferably alky, of from 8 to 20, preferably 10 to 18, especially preferably 12 to 18 carbon atoms, p is a number of from 2 to 8 on average, preferably 3 to 6, and q is a number of from 2 to 12 on average, preferably 4 to 10, can be advantageously used where low foaming characteristics are desired. In addition, these surfactants have the advantage of low gelling temperatures. Mixtures of two or more of the mixed ethylene oxide-propylene oxide fatty alcohol condensation product can be used as can mixtures of the mixed ethylene oxide-propylene oxide condensation products with any of the above alkoxylated nonionics, or mixtures of the ethoxylated nonionics can also be used.

Ampholytic detergents are also suitable for the invention. Ampholytic detergents are well known in the art and many operable detergents of this class are disclosed by A. M. Schwartz, J. W. Perry and J. Berch in "Surface Active Agents and Detergents," Interscience Publishers, New York, 1958, Vol. 2. Examples of suitable amphoteric detergents include: alkyl betaiminodipropionates, $RN(C_2H_4COOM)_2$; alkyl beta-amino-propionates, $RN(H)C_2H_4COOM$; and long chain imidazole derivatives having the general formula:

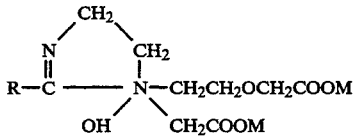

wherein in each of the above formulae, R is a hydrophobic hydrocarbyl group, preferably an aliphatic group, containing from about 8 to 20 carbon atoms, especially 10 to 18 carbon atoms, and M is a cation, e.g. alkali metal, ammonium salt, amine, alkanol amine, etc., to neutralize the charge of the anion. Specific operable amphoteric detergents include, for example, the disodium salt of undecylcycloimidiniumethoxyethionic acid-2-ethionic acid, dodecyl beta alanine, and the inner salt of 2-trimethylamino lauric acid.

An especially preferred class of amphoteric surfactants are the glycinate derivatives of the formula:

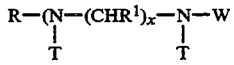

wherein R is a hydrocarbyl group, preferably aliphatic, of 8 to 20 carbon atoms, $R^1$ is hydrogen or alkyl of 1 to 6 carbon atoms, preferably hydrogen, $R^2$ is alkylene of 1 to 6 carbon atoms, preferably methylene, T is hydrogen or W, preferably W, W is $R^2COOM$, M is hydrogen, alkali metal, alkaline earth metal, ammonium or substituted ammonium, such as lower alkanolammonium, e.g., triethanol-ammonium, x is 2 to 3 and y is 2 to 4. A preferred amphoteric surfactant is of the formula

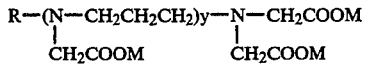

wherein R is an aliphatic hydrocarbyl, preferably fatty alky or fatty alkylene, of 16to 18 carbon atoms, M is alkali metal, and y is 3 to 4. More preferably R is tallow-alkyl (which is a mixture of stearyl, palmityl and oleyl in the proportions in which they occur in tallow), M is sodium and y is about 3.5, representing a mixture of about equal parts of the amphoteric surfactant wherein y is 3 and such amphoteric surfactant wherein y is 4. Among the more preferred amphoteric surfactants of this type is that available commercially under the trade name Ampholak TM 7TX, which is obtainable from Kenobel AB, a unit of Nobel Industries, Sweden.

The amount of the detergent active compound(s) will generally range from about 5% to about 75%, more usually from about 5% to about 30%, especially from about 8% to about 15%, by weight of the composition. The preferred anionic surfactant is usually present in amounts of from about 1 to 25%, preferably from about 2 to 20%, especially preferably from about 3 to 15% by weight of the composition.

The nonionic surfactant, when present, is usually contained in amounts of from about 0.5 to 10%, preferably from about 1 to 8%, by weight and the amphoteric, when present, may comprise from about 0.3 to 15%, preferably 1 to 10%, especially preferably from about 2 to 8% by weight, based on the total composition.

II. Detergent Builder

While any of the conventional inorganic or organic water-soluble or water dispersible detergency builders can be used in the compositions of this invention, the primary and essential builders are the water-insoluble aluminosilicate zeolites such as zeolite A, usually in the form of its crystalline hydrate although amorphous zeolites may also be useful.

The zeolites which may be employed in practicing the present invention include the crystalline, amorphous and mixed crystalline-amorphous zeolites of both natural and synthetic origins which are of satisfactorily quick and sufficiently effective activities in counteracting hardness ions, such as calcium ions, in wash waters. Preferably, such materials are capable of reacting sufficiently rapidly with hardness cations, such as calcium, magnesium, iron and the like or any one of them, to soften wash water before adverse reactions of such hardness ions with other components of the synthetic organic detergent composition occur. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eq./g. and a hardness depletion rate residual hardness of 0.02 to 0.05 mg. $CaCO_3$/-liter in one minute, preferably 0.02 to 0.03 mg./l., and less than 0.01 mg./1. in 10 minutes, all on an anhydrous zeolite basis.

Although other ion exchanging zeolites may also be utilized normally the finely divided synthetic zeolite builder particles employed in the practice of this invention will be of the formula $$(Na_2O)_x(Al_2O_3)_y(SiO_2)_z \cdot wH_2O$$

wherein x is 1, y is from 0.8 to 1.2, preferably about 1, z is from 1.5 to 3.5, preferably 2 to 3 or about 2 and w is from 0 to 9, preferably 2.5 to 6.

The water soluble crystalline aluminosilicates used are often characterized by having a network of substantially uniformly sized pores in the range of about 3 to 10 Angstroms, often being about 4 A (normal), such size being uniquely determined by the unit structure of the zeolite crystal. Of course, zeolites containing two or more such networks of different pore sizes can also be satisfactorily employed, as can mixtures of such crystalline materials with each other and with amorphous materials, etc.

The zeolite should be a univalent cation-exchanging zeolite, i.e., it should be an aluminosilicate of an univalent cation such as sodium, potassium, lithium (when practicable) or other alkali metal, ammonium or hydrogen. Preferably the univalent cation of the zeolite molecular sieve is an alkali metal cation, especially sodium or potassium and most preferably, is sodium, but various other types are also useful.

Crystalline types of zeolites utilizable as good ion exchangers in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolites are well known in the art and are more particularly described in the text Zeolite Molecular Sieves by Donald W. Beck, published in 1974 by John Wiley & Sons. Typical commercially available zeolites of the aforementioned structural types are listed in Table 9.6 at pages 747–749 of the Breck text, which table is incorporated herein by reference.

Preferably, the zeolite used in the invention is synthetic and it is also preferable that it be type A or similar structure, particularly described at page 133 of the aforementioned text. Good results have been obtained when a Type 4A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4% up to about 36% of the zeolite total weight, depending on the type of zeolite used. The water-containing hydrated form of the molecular sieve zeolite (preferably about 15 to 70% hydrated) is preferred in the practice of this invention when such crystalline product is used. The manufacture of such crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient temperature so that their water contents are in the range of about 5 to 30% moisture, preferably about 10 to 25%, such as 7 to 22%. However, the moisture content of the molecular sieve zeolite being employed may be much lower, as was previously described.

The zeolites used in this invention should usually also be substantially free of absorbed gases, such as carbon dioxide, since such gas-containing zeolites can produce undesirable foaming when the zeolite-containing detergent is contacted with water; however, sometimes the foaming is tolerated and it may sometimes be desirable.

Preferably, the zeolite should be in a finely divided state with the ultimate particle diameters being up to 20 microns, e.g., 0.005 or 0.01 to 20 microns, preferably being from 0.01 to 15 microns and especially preferably of 0.01 to 8 microns mean particle size, e.g., 3 to 7 or 12 microns, if crystalline, and 0.01 to 0.1 microns, e.g., 0.01 to 0.05 micron, if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not sufficiently and satisfactorily suspended.

Although the crystalline synthetic zeolites are more common and better known, amorphous zeolites may also be used, as may mixed crystalline-amorphous materials and mixtures of the various types of zeolites described. The particle sizes and pore sizes of such materials may be like those previously described but variations from the indicated ranges may be made, as described, providing that the materials function satisfactorily as builders and do not objectionably overwhiten dyed materials with which they are treated in aqueous media. Although it is preferred that the composition of this invention are free of phosphates, in view of the concern for the environmental impact attributed to phosphates and other phosphorus containing compounds, nevertheless, where use of phosphorous containing builders is not prohibited or not an environmental problem, small amounts (e.g., up to about 5%) of phosphate builders, as well as other of the inorganic or organic builders may also be used in place of part are all of the zeolite builder. In fact, in a preferred embodiment of the invention a polyphosphonate or amino polyphosphonate builder or sequestering agent, as described in further detail below is included in relatively small amount in the invention compositions. Accordingly, unless the context indicates otherwise, reference to the invention compositions as phosphate-free should be construed as referring to absence of convention phosphate and polyphosphate type builders such as sodium tripolyphosphate, etc. while allowing the presence of phosphonate type compounds.

Among the inorganic builders, the alkali metal polyphosphates and alkali metal carbonates or bicarbonates are preferred. Sodium tripolyphosphate is especially preferred but other phosphate builders, such as tetrasodium pyrophosphate, tetrapotassium pyrophosphate, sodium metaphosphate, and the like, can also be used. Mixtures of sodium tripolyphosphate and sodium carbonate, as disclosed in U.S. Pat. No. 4,842,769, incorporated herein by reference, may also be useful.

Suitable builders of the organic type include, for example, polycarboxylate builders, such as aminopolycarboxylates, for example, sodium and potassium ethylene-diamine tetraacetate; sodium and potassium nitrotriacetate; and the polyacetal polycarboxylates, such as those described, for example, in U.S. Pat. Nos. 4,144,226 and 4,315,092. Other organic builders of the polycarboxylate type include the water-soluble salts, especially sodium and potassium salts, of mellitic acid, citric acid, pyromellitic acid, benzene polycarboxylic acids, carboxymethyloxy succinic acid, cis-cyclohexane hexacarboxylic acid, and the like. Citric acid salt, e.g. sodium citrate, is often a preferred builder in non-phosphate or low phosphate formulations, and may also be used in this capacity in the detergent-enzyme compositions of this invention, in addition to any citrate which may be used in the enzyme stabilizing system of this invention.

Polyphosphonate salts represent another useful class of detergency builders, for example, sodium and potassium salts of ethylene diphosphonic acid, ethane-1-hydrosy-1, 1-diphosphonic acid, and ethane-1,1,2-triphosphonic acid.

Aminopolyphosphonate compounds are also useful builders and may also be advantageously used as sequestrants. Suitable examples include soluble salts, e.g. sodium or potassium salts, of diethylene triamine pentamethylene phosphonic acid, ethylene diamine tetramethylene phosphonic acid, and hexamethylenediamine tetramethylene phosphonic acid. These phosphonate compounds, when used, will generally be present in relatively minor amount based on the zeolite detergent builder, for example, less than 1% by weight of the composition such as up to about 0.8%, e.g., from 0.05 to 0.5%, preferably 0.1 to 0.4 by weight of the composition.

The total amount of detergent builder may range from about 5% to about 50%, especially from about 5% to about more preferably from about 10 or 15 to 25%, by weight, based on the total composition.

III. Polymeric Structurant

The present compositions incorporate a water soluble polymeric polycarboxylate or derivative thereof, especially homopolymers and copolymers of acrylic acid and its salts which function as structuring agents and viscosity stabilizers, and in some cases can act to enhance cleaning performance under actual use conditions and may also be useful as deflocculents. Such polymers include polyacrylic acid, polymethacrylic acid, acrylic acid-methacrylic acid copolymers, (meth)acrylic acid/-maleic anhydride copolymers, hydrolyzed polyacrylamide, hydrolyzed polymethacrylamide, hydrolyzed acrylamide-methacrylamide copolymers, hydrolyzed polyacrylonitrile, hydrolyzed polymethacrylonitrile, hydrolyzed acrylonitrile-methacrylonitrile copolymers, or mixtures thereof. Water soluble salts or partial salts of these polymers such as the respective alkali metal (e.g. sodium, potassium) or ammonium salts can also be used. The weight average molecular weight of the polymers is from about 500 to about 50,000 or more and is preferably within the range of from 500 to 10,000 especially 800 to 5,000. Preferred polymers include polyacrylic acid, the partial sodium salt of polyacrylic acid or sodium polyacrylate having weight average molecular weights within the range of 500 to 25,000 or 30,000, e.g., 500 to 8,000. These polymers are commercially available, and methods for their preparation are well-known in the art.

For example, commercially-available polyacrylate solutions useful in the present cleaning compositions include the sodium polyacrylate solution, Colloid® 207 (Colloids, Inc., Newark, N.J.); the polyacrylic acid solution, Aquatreat® AR-602-A (Alco Chemical Corp., Chattanooga, Tenn.); the polyacrylic acid solutions (50–65% solids) and the sodium polyacrylate powders (M.W. 2,100 and 6,000) and solutions (45% solids) available as the Goodrite® K-700 series from B.F. Goodrich Co.; and the sodium- or partial sodium salts of polyacrylic acid solutions (M.W. 1,000 to 45,000 available as the Acrysol® series from Rohm and Haas, such as Acrysol LMW20N; Veriscol® E5, E7 and E9 ex Allied Colloids, average molecular weights 3,500, 27,000 and 70,000 respectively; Narlex® LD 30 and 34 ex National Adhesives and Resins Ltd., average molecular weights 14,000 and 72,000 respectively; and Sokalan® PA 50 and PA 110S ex BASF, average molecular weights 30,000 and 250,000 respectively; acrylic acid/-maleic anhydride copolymers, for example, Sokalan (Trade Mark) CP5, CP7, and CP12 ex BASF, average molecular weights 70,000, 50,000 and 3000, respectively; acrylic phosphinates, for example, the DKW range ex National Adhesives and Resins Ltd. or the Belsperse® range ex Ciba-Geigy AG, as disclosed in EP 182 411A (Unilever).

The polymeric structurant/dispersant is present in the composition in a minor but effective amount to contribute, together with the remaining components of the composition a sufficient cohesiveness and body such that the solid particles, including zeolite builder and clay softener are stably suspended in the aqueous media without flocculating and without an increase in viscosity. Although the amount of the polymeric structurant effective to prevent flocculation and maintain product pourability will vary depending on the type and molecular weight of the polymer and the types and amounts of suspended particles, surfactant(s) and other soluble components, generally good results will be obtained with amounts of polymeric structurant in the range of from about 0.5 to 3% by weight, based on the total composition. More preferably, from about 0.8 to 2%, especially from about 0.8 to 1.5% of the polymeric structurant/dispersing agent is present in the composition.

IV. Clay Softening Agent

A preferred fabric-softening agent is a smectite clay, such as sodium and calcium montmorillonites, sodium saponites, and sodium hectorites. The sodium and calcium bentonites which are colloidal clay containing montmorillonites, such as the swelling bentonites wherein the predominant cation is sodium or calcium, are preferred. Furthermore, the calcium clays often provide superior softening performance than the sodium clays.

The swelling capacity of bentonite is generally associated with its fabric softening properties. In water the swelling capacity of sodium bentonite is in the range of 3 to 20 milliliters/gram, preferably 7 to 15 ml/gram, and its viscosity, at 6% concentration in water, is usually in the range of 3 to 30 centipoises, preferably 8 to 30 centipoises.

Preferred swelling bentonites are solid under the trademark HI-JEL by Georgia Kaolin Co. These materials are the same as bentonites which were formerly sold under the trademarks MINERAL COLLOID and THIXO-JEL. They are selectively mined and beneficiated bentonites, and those considered to be most useful are available as HI-JEL Nos. 1, 2, 3, etc., corresponding to THIXO-JEL's Nos. 1, 2, 3, and 4. Such materials have a maximum free moisture content (before addition to the liquid medium) of 4% to 8% and specific gravities of about 26. The bentonite is preferably one which will pass through a 200 mesh U.S. Sieve Series sieve, and most preferably at least 90% of the particles will pass through a No. 325 sieve, so that the equivalent diameter of the bentonite may be considered to be less than 74 microns, and more preferably less then about 44 microns.

Typical chemical analyses of some bentonites that are useful for making the present liquid detergents show that they contain from 64.8 to 73.0% of $SiO_2$, 14 to 18% of $Al_2P_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Although the Western bentonites are preferred, it is also possible to utilize other bentonites, such as those which may be made by treating Italian or similar bentonites containing relatively small proportions of exchangeable monovalent metals (sodium and potassium) with alkaline materials, such as sodium carbonate or calcium chloride, to increase the cation exchange capacities of such products. It is considered that the $Na_2O$ content of the bentonite should be at least about 0.5%, preferably at least 1% and more preferably at least 2% so that the clay will be satisfactorily swelling, with good softening and dispersing properties in aqueous suspension. Preferred swelling bentonites of the types described about are sold under the trade names Laviosa and Winkelmann, e.g. Laviosa AGB and Winkelmann G-13.

Other bentonites which are particularly useful in the present liquid detergent compositions because of their white or very light color include American Colloid Company's Polarite KB 325, a California bentonite, and Georgia Kaolin's GK 129, a Mexican bentonite.

When present, the amount of the clay softening agent will usually be within the range of from about 0.5 to about 20% by weight, preferably from about 3 to 18% by weight, more preferably from 5 to 12% by weight, based on the total composition.

V. Other Optional Components

Other natural or synthetic thickening agents or viscosity modifiers may also be added to the compositions. Such conventional thickening agents include, for example, methyl cellulose, carboxymethylcellulose (CMC), starch, polyvinyl pyrrolidone (PVP), gelatin, colloidal silica, natural or synthetic clays and the like. When present, such thickening agents may be added in amount usually up to about 10,000 cps, preferably up to about 7,000 cps.

Other conventional materials may also be present in the liquid detergent compositions of the invention, for example, soil-suspending agents, hydrotropes, corrosion inhibitors, dyes, perfumes, silicates, optical brighteners, suds boosters, suds depressants, e.g. silicone anti-foaming agents, germicides, e.g. quaternary ammonium salts, preservatives, e.g. quaternium 15, anti-tarnishing agents, opacifiers, fabric-softening agents, oxygen-liberating bleaches such as sodium perborate or percarbonate with or without bleach precursors, buffers and the like. Such other conventional materials may be used in the amounts they are normally used generally up to about 5% by weight, more preferably up to about 3% by weight, although higher amounts which do not interfere with the stability of the composition may be used, if desired.

An optional, but often preferred additive, in minor amounts, is a higher fatty acid, which may be saturated or unsaturated, and may contain from about 10 to about 22 carbon atoms, preferably from about 16 to 20 carbon atoms. Oleic acid is especially preferred in amounts of from 0.1 to about 5%, preferably from about 0.5 to 2.5%, by weight of the composition. However, when it is desired to incorporate an anionic soap surfactant, the oleic acid or other higher fatty acid can be present in amounts up to about 20% preferably up to about 10% by weight of the composition.

These higher fatty acids function in the invention compositions as anti-foaming agents and also function as soap surfactants in combination with the neutralizing cations, e.g., sodium or potassium, in the composition. They may be used alone for this anti-foaming function but are often used in combination with the polysiloxane (silicone) anti-foaming agents. The silicone anti-foaming agents will generally be present in minor amounts compared to the fatty acid. Suitable ratios (by weight) of the fatty acid anti-foaming agent to silicone anti-foaming agent may range from about 100:1 to 1:10, preferably 50:1 to 1:1, especially 30:1 to 2:1.

A highly preferred additive to the invention compositions is an enzyme which may be, and generally is, used with an enzyme stabilization system.

The alkaline proteolytic enzymes suitable for the present compositions include the various commercial liquid enzyme preparations which have been adapted for use in detergent compositions. Enzyme preparations in powdered form are also useful although, as a general rule, less convenient for incorporation into the built liquid detergent compositions. Thus, suitable liquid enzyme preparations include "Alcalase," "Savinase," and "Esperase", all trademarked products sold by Novo Industries, Copenhagen, Denmark, and "Maxatase," "Maxacal," and "AZ-Protease" sold by Gist-Brocades, Delft, The Netherlands.

Among the suitable alpha-amylase liquid enzyme preparations are those sold by Novo Industries and Gist-Brocades under the tradenames "Termamyl" and "Maxamyl," respectively.

"Esperase" is particularly preferred for the present compositions because of its optimized activity at the higher pH values corresponding to the built detergent compositions.

Mixtures of proteolytic and amylase enzymes can and often are used to assist in removal of different types of stains.

The proteolytic enzyme and/or amylase enzyme will normally be present in the compositions in an effective amount in the range of from about 0.01% to about 5%, preferably from about 0.5% to about 2%, by weight of the composition. For the proteolytic enzymes, the suitable amounts will generally provide from about 0.005 to about 0.1, more preferably from about 0.01 to about 0.07 Anson units per gram of composition. depending on the use to which the composition will be applied. Generally, lower levels of amylase are required.

Any of the known and conventional enzyme stabilizing compounds may be used in this invention.

The preferred enzyme stabilizing system of the invention described in detail in our prior copending application Ser. No. 07/684,149, now U.S. Pat. No. 5,221,495, incorporated herein by reference, and is a mixture of (i) a boron compound selected from among boric acid, boric oxide and alkali metal borate, particularly sodium borate, especially sodium tetraborate, e.g. boras ($Na_2BrO_7.10H_2O$), (ii) an hydroxpolycarboxylic acid having from 4 to 8 carbon atoms, preferably 4, 5 or 6 carbon atoms, two or three carboxyl (—COOH) groups and 1 to 4, preferably 2 or 3 hydroxyl (—OH) groups, and (iii) a water-soluble calcium salt capable of providing calcium ($Ca++$) ions in aqueous media.

The boron compound (i) is boric acid or a compound capable of producing boric acid, such as boric oxide or a salt, such as sodium borate. Borax is readily available and is preferred.

The boric acid compound is used in an amount of from about 0.25% to about 10%, preferably from about 0.5% to about 8%, more preferably from about 1% to about 5%, such as 2%, 3% or 4%, by weight, of the total detergent composition.

Citric acid is the preferred hydroxypolycarboxylic acid, especially in view of its ready availability and its contribution to improving the overall physical stability of the composition, i.e., prevent phase separation. However, other hydroxycarboxylic acids, such as malic acid, tartaric acid, isocitric acid, trihydroxyglutaric acid and mucic acid, may also be used. Lactic acid, which has only 3 carbon atoms, will also provide enzyme stabilization; however, replacing e.g. citric acid with an equal weight of lactic may result in compositions which are less physically stable—i.e. undergo phase separation.

The acid is usually incorporated into the composition as the free acid (or hydrated free acid), but may also be added in the form of its salt, especially alkali metal salt. In fact, it is thought that under the preferred alkaline pH conditions for the detergent compositions, the hydroxypolycarboxylic acid will be present in its ionized (salt) state.

The hydroxypolycarboxylic acid is used in an a mount of from about 1% to about 3%, preferably from about 1.2 to 2.6%, by weight of the total detergent composition. However, when, e.g., citric acid is also used as a builder it may be added in amounts up to about 20% by weight, preferably up to about 12% by weight, of the composition.

The level of calcium ion as component (iii) in the detergent composition is from about 18 to about 50 millimoles, preferably from about 22 to about 36 millimoles, per liter of the composition. Suitable water-soluble calcium salts which can be used as a source of calcium ion include both inorganic and organic salts, such as calcium chloride, calcium acetate and calcium formate. Calcium chloride is preferred. About 0.2% $CaCl_2$ corresponds to about 18 millimoles $Ca++$ per liter. A small amount of calcium ion, generally from about 0.05 to about 0.4 millimole per liter, is often also present due to calcium in the enzyme preparation or water, but any such naturally present calcium ion will generally be insignificant to the added calcium ion.

While the above described three component stabilizing system is preferred, other known enzyme stabilizers, such as those described in the background section of our prior application Ser. No. 07/684,149, now U.S. Pat. No. 5,221,495, incorporated herein by reference, may also be used.

VI. Liquid Carrier

The liquid carrier for the liquid compositions of this invention is preferably water alone but an aqueous carrier containing minor amounts of a lower alcohol, such as ethanol or isopropanol, may also be used in some cases.

Generally, water levels may be up to about 70% by weight of the composition, for example, from about 10 to about 70%, preferably from about 15% to 50%, by weight. The water may be deionized, but usually tap water is sufficient.

The viscosity of the present liquid detergent is normally in the range of about 800 to 10,000 centipoises, preferably 2,000–7,000 centipoises, but products of other suitable viscosities may also be useful. At the viscosities mentioned, the liquid detergent is pourable, stable, nonseparating and uniform. The pH of the liquid detergent suspension usually in the range of 7 to 11.5, preferably 7 to 10.0, appears to help to maintain product stability and pourability.

As necessary, pH modifiers, such as water soluble bases, e.g. caustic, KOH, amines, or ammonia, or acids, preferably mineral acids, e.g. HCl, will be added to obtain the desired pH level.

VII. Processing

Although the ingredients can often be added in any desired order usually the enzyme, when present, will be the last added ingredient and will always follow the addition of the enzyme stabilizing additives.

Conventional manufacturing methods may be employed to a large extent in the prosecution of the described liquid detergent compositions. In one procedure, a portion of the aqueous medium may be added to a mixing vessel and the surfactant components may be mixed therewith in any suitable order, such as anionic, nonionic and amphoteric detergents, followed by higher fatty acid and hydroxypolycarboxylic acid and neutralizing agent, such as sodium hydroxide solution. Then zeolite and/or other builders may be added, followed by polyacrylate, enzyme and boric acid and calcium ion source. Bentonite may be pre-mixed with another portion of the water or may be added directly to the composition, sometimes with additional water, after which the balance of the water, brightener, dye and perfume may be admixed. When other components of the detergent composition are also employed, they may be added to the mixer at appropriate times and the various orders of addition may be modified to make them appropriate to the types of products being made and to the types of equipment being used.

In an alternative procedure which has been found convenient, there is first formed a premixture (premix) of the calcium compound with some or all of the surface active compounds and with some or all of the hydroxypolycarboxylic acid. The premix is prepared as a homogeneous aqueous mixture wherein the aqueous media (e.g. water) may be added as such or as a carrier for one of the other ingredients in the premix. Anti-foaming agent may be included in the premix or in the main batch or both. Thickening or viscosity modifiers and clay softener are preferably added to the main mixing bath, the viscosity modifiers generally being added at or near the beginning of the mixing sequence and clay added near the end of the mixing sequence before or after the premix.

A convenient order for addition of the ingredients is water, polymeric structurant, thickener, if any, coloring agents and/or brighteners, borax and builder followed by the clay and premix and anti-foaming agent. Final pH adjustment is usually made right before the enzyme component(s). The precise order of addition will depend on the specific ingredients, type of mixing apparatus and desired characteristics in the final product.

The following examples illustrate, but do not limit the invention. Unless otherwise indicated, all parts and percentages are by weight and temperatures are in ° F.

EXAMPLE 1

A pourable liquid heavy duty detergent composition is prepared by first thoroughly mixing the following ingredients in the recited order until each ingredient is completely dissolved or uniformly dispersed.

| Ingredient | Amount Added Concentration (wt %) |
|---|---|
| Citric Acid, hydrate | 2.0 |
| $CaCl_2$ | 0.3 |
| Borax | 3.0 |
| Nonionic(2) | 3.5 |
| Tallow Amphpolycarboxy-glycinate(4) (30%) | 6.0 |
| AEOS(1) (28%) | 31.7 |
| Sodium Polyacrylate (MW = 2000) (40%) | 1.0 |
| Zeolite A | 15.0 |
| Calcium Bentonite Clay | 11.0 |
| Oleic Acid | 1.5 |
| Silicone Antifoam (20%) | 0.75 |
| Acid Blue color | 0.002 |
| Food Blue 5 Color | 0.001 |
| Tinopal LMX | 0.3 |
| NaOH (50%) | 2.0 |
| Quaternium 15(3) | 0.1 |
| Jumelle perfume | 1.0 |
| Alcalase 2.5 LDX | 0.6 |
| Water q.s. to | 100% |
| HCl to pH = | 7.3 |

(1)Sodium alkyl polyethoxy sulfate wherein the alkyl is 12 to 15 carbon atoms and the polyethoxy is 3 ethoxy groups.
(2)$C_{13}$–$C_{15}$ fatty alcohol condensed with 7 moles ethylene oxide and 4 moles propylene oxide
(3)Dowicil 200 by Dow Chemical [cis-isomer of 1-(3-chloroalkyl)-3,5,7-triaza-1-azoniaadamantine chloride]
(4)Ampholak TM 7TK, from Kenobel AB

EXAMPLE 2

The following composition is prepared, as described above:

| Ingredient | Amount (as actives) (weight percent) |
|---|---|
| AEOS-3EO(70%) | 8.0 |
| Nonionic(1) | 3.0 |
| Zeolite A | 16.8 |
| Norasol LMW20N(2) | 1.0 |
| Calcium Clay | 10.0 |
| Oleic Acid | 3.0 |
| Dequest 2060S | 0.3 |
| Tinopal CBS-X | 0.05 |
| Tinopal LMS-X | 0.1 |
| Durazym 16.0 L (Novo)(3) | 0.3 |
| Citric acid, anhydrous | 1.8 |

-continued

| Ingredient | Amount (as actives) (weight percent) |
|---|---|
| Calcium chloride, dihydrate | 0.4 |
| Borax, granular | 3.0 |
| Silicone S132 | 0.2 |
| Linesse Perfume | 0.8 |
| Dowicil 75 | 0.1 |
| Sodium chloride | 0.5 |
| Water (Tap) Balance to | 100 |

(1)$C_{12}$–$C_{14}$ fatty alcohol with 3 moles ethylene oxide
(2)Sodium polyacrylate, MW = 2000
(3)Protease enzyme In the above formulation, the oleic acid and citric acid are neutralized with 1.60% KOH. The resulting composition is an easily pourable stable heavy duty liquid laundry detergent.

Similar results are obtained if in the above formulation a small amount of dodecylbenzene sulfonate (LAS) anionic is used in place of a portion of the AEOS.3EO surfactant, e.g., AEOS.3EO=6%, LAS=2%, nonionic=3%.

EXAMPLE 3

In order to demonstrate that the mechanism of stabilization of the built aqueous laundry detergent compositions of this invention is independent of the electrical conductivities and spherulite phase described in the aforementioned patent to Haslop a series of experiments was carried out with two different formulations of surfactants to determine whether or not the electrolyte levels in the subject compositions correspond to the First Minimum Conductivity of the surfactants plus water components of the composition.

The results of these experiments, as described below, lead to the conclusions that:

1. The electrolytes level used in the stable compositions of this invention does not correspond to the First Minimum Conductivity of the surfactants/water composition.

2. The First Minimum Conductivity of the surfactants composition does not correspond to the drop of conductivity in the finished (final) product but to the rising (increasing) part of the curve.

In carrying out these experiments only the citrate and chloride components are considered as "Electrolytes". Borax is only sparingly soluble in water (i.e., is lower than that of sulfate) and, therefore, is not considered to fall within Haslop's definition of Electrolyte. Calcium chloride also fails to meet the Haslop definition of Electrolyte.

The following composition A is used in the first series of conductivity measurements:

| COMPOSITION A | Weight % |
|---|---|
| AEOS.3EO (70%) | 5.8 |
| Nonionic(1) | 2.7 |
| LAS | Varied |
| Zeolite A | 15.8 |
| Norasol LMW20N | 1.0 |
| Calcium Clay | 10.0 |
| Dequest 2060S | 0.3 |
| Oleic Acid | 2.2 |
| Tinopal LMS-X | 0.1 |
| Tinopal CBS-X | 0.05 |
| Silicone S132 | 0.2 |

-continued

| COMPOSITION A | Weight % |
|---|---|
| Alcalase 2.5 L DX | 0.3 |
| Savinase 16.0 L | 0.2 |
| Citric Acid Monohydrate | 2.0 |
| Borax Granular | 3.0 |
| Calcium Chloride | 0.4 |
| Linese Perfume | 0.8 |
| Dowicil 75 | 0.1 |
| NaCl | 0.5 |
| KOH | 1.6 |
| Water | Balance |

(1)$C_{12}$–$C_{14}$ fatty alcohol with 3 moles ethylene oxide

The results of the conductivity measurements for Composition A are shown in FIGS. 1–5.

Figure 6:
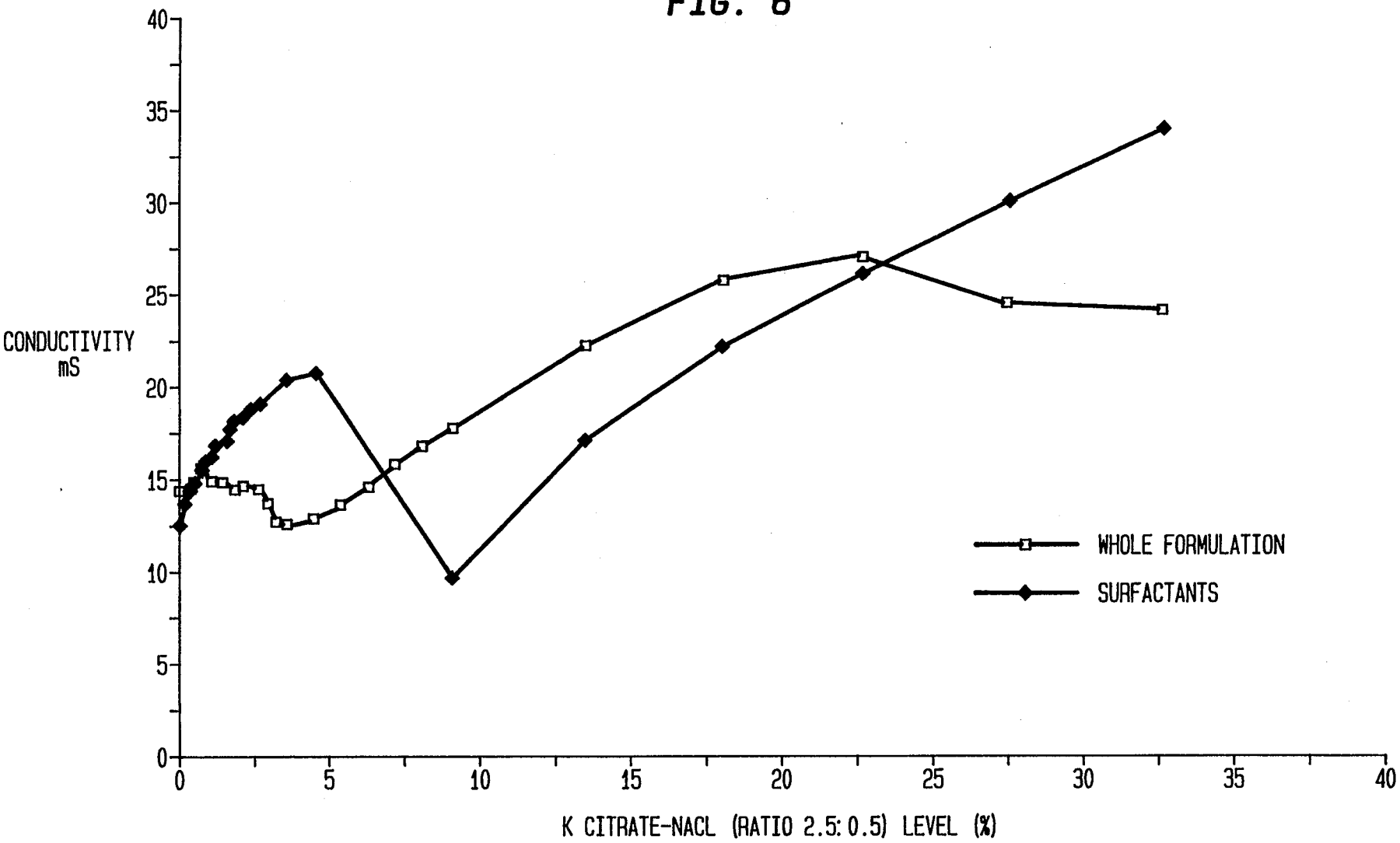
FIG. 6 is a conductivity curve of another formulation as a function of electrolytes level for the whole composition (□) or surfactants only (•).

The composition of Example 2 was used in the second series of conductivity measurements. The results are shown in FIG. 6.

In each series of experiments the tests were carried out in two ways. The Electrolytes (K citrate and chloride 2.5:0.5) are incorporated in:

1. Surfactants (AEOS,NI soap, and (for Composition A) Las at various levels); and 2. The whole formulation excluding Electrolytes.

Figure 5:
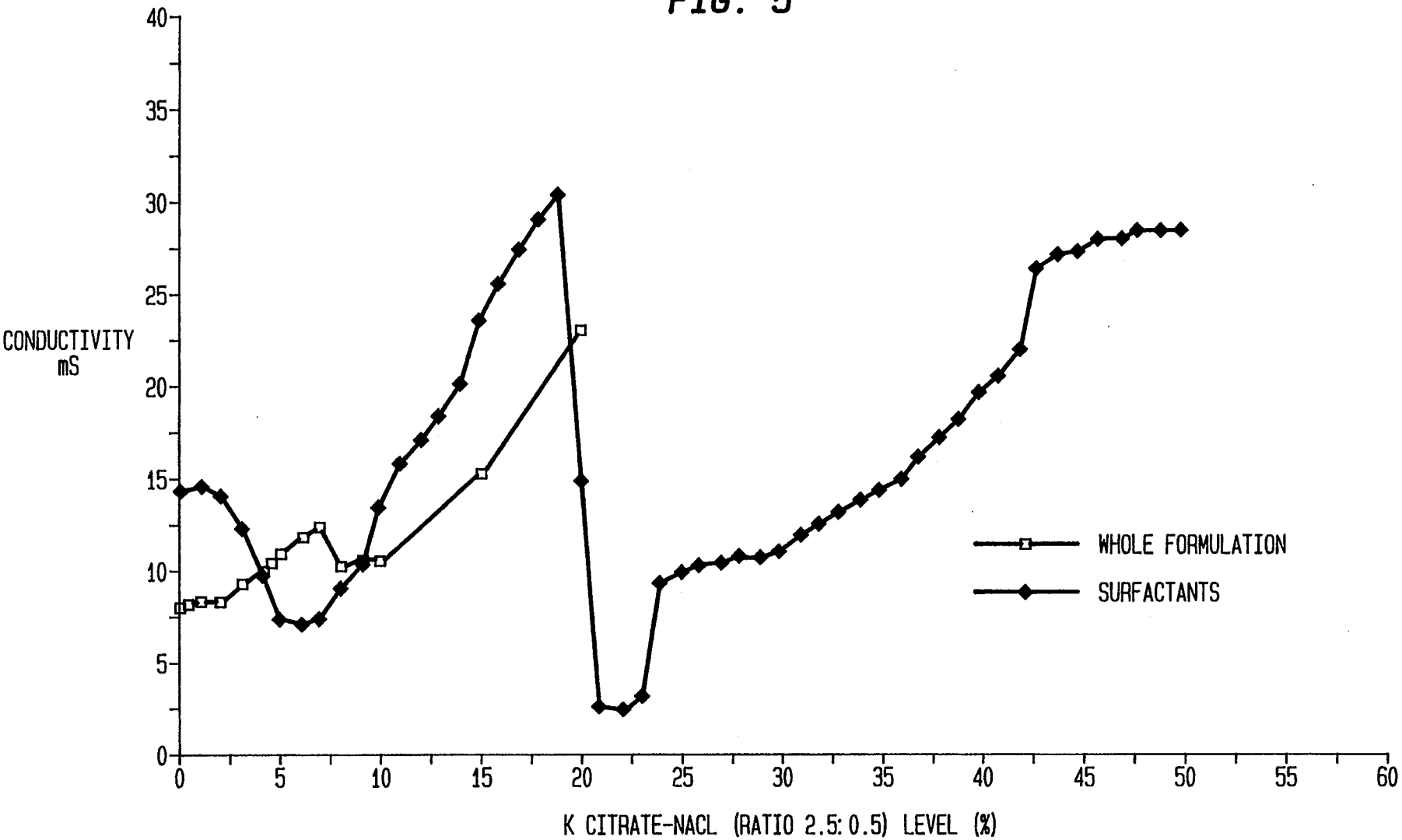

The First Conductivity Minimum is not clearly observed in the whole formulation (finished product). A very small decrease of conductivity is observed at about 5% Electrolyte in the whole formula of Composition A (FIG. 1) and Example 2 without LAS (FIG. 6). At 3.3% LAS (Composition A) a First Conductivity Minimum is observed between 8 and 10% electrolytes (FIG. 5). In the "surfactants only" tests, the First Conductivity Minimum for the composition without LAS is at about 20% electrolyte for composition A (FIG. 1) and at 10% for Example 2 (FIG. 6). As the LAS content increases (see FIGS. 2–4), the First Conductivity Minimum in the "surfactant only" tests is shifted to about 6 to 7% Electrolytes.

Since only a total of about 3% of K citrate and sodium chloride are present in the finished product as shown in these examples, it is evident that stabilization is not a function of electrolyte level. Furthermore, microphotographs of the finished product compositions of this invention do not show the existence of space-filling spherulites which is a characteristic of the stabilized composition of Haslop.

EXAMPLE 4

The composition of Example 2 was repeated except that the clay and polyacrylate, or polyacrylate only, were omitted. The results are shown in the following Table 1.

In the absence of the polyacrylate and clay phase separation was observed by the end of one week and increased with time. In the composition containing clay but not polyacrylate there was no phase separation after 3 months, at temperatures ranging from 4° C. to 38° C., however, the viscosity of the composition increased from about 2400 cps to from about 15,000 to 20,000 cps.

It is presumed, on the basis of the foregoing observations, that in the present invention stabilization is dependent on an interaction between the surfactant structure and the polymeric dispersion of the high clay payload which in turn maintains the zeolite builder in suspension.

TABLE I

| EXAMPLE 2 EXCLUDING: | TEMPERATURE | AGEING RESULTS | 0 DAY | 1 WEEK | 2 WEEKS | 1 MONTH |
|---|---|---|---|---|---|---|
| NORASOL CLAY | 4 C. | VISCO (cps) | | 4625 | 4750 | 4400 |
| | | CONDUCTIVITY (mS) | | 18.25 | 17.14 | 18 |
| | | PHASE SEPARATION | | 2.3% | 3.4% | 3.40% |
| | RT | VISCO (cps) | 7900 | 6000 | 5350 | 4625 |
| | | CONDUCTIVITY (mS) | 16.6 | 19.1 | 17.45 | 17.9 |
| | | PHASE SEPARATION | | 8% | 8% | 10.50% |
| | 35 C. | VISCO (cps) | | 5375 | 4900 | 4250 |
| | | CONDUCTIVITY (mS) | | 18.9 | 17.5 | 17.5 |
| | | PHASE SEPARATION | | 2.3% | 2.3% | 3.40% |
| NORASOL | 4 C. | VISCO (cps) | | 11700 | 11400 | 11000 |
| | | CONDUCTIVITY (mS) | | 12.9 | 13.3 | 13.3 |
| | | PHASE SEPARATION | | 0 | 0 | 0 |
| | RT | VISCO (cps) | 22400 | 19600 | 15700 | 13100 |
| | | CONDUCTIVITY (mS) | 12.6 | 14.1 | 13.4 | 13.2 |
| | | PHASE SEPARATION | | 0 | 0 | 0 |
| | 35 C. | VISCO (cps) | | 22000 | 19700 | 14000 |
| | | CONDUCTIVITY (mS) | | 13 | 12.5 | 13.2 |
| | | PHASE SEPARATION | | 0 | 0 | 0 |

For the complete formulation of Example 2 the degree of phase separation after ageing for 3 months is as follows:

| Temperature | Phase separation (%) |
|---|---|
| 4° C. | 4.8 |
| R.T. | 2.3 |
| 43° C. | 4.4 |

For the purpose of the present invention, compositions exhibiting phase separation of less than about 5% over the temperature range of 4° C. to 43° C. are considered stable.

What is claimed is:

1. An enzyme-containing liquid detergent composition comprising:
   - A) from about 5 to about 75% by weight, of one or more surface active detergent compounds;
   - B) from about 5 to about 30%, by weight, of one or more detergency builders comprising a zeolite;
   - C) from about 0.01 to about 5%, by weight, of protease enzymes;
   - D) an enzyme stabilization system comprising:
     - (i) from about 0.25 to about 10%, by weight, of a boron compound selected from the group consisting of boric acid, boric oxide, and alkali metal borates;
     - (ii) from about 1 to about 3%, by weight, of an hydroxypolycarboxylic acid selected from the group consisting of alphatic di- and tri-carboxylic acids with from 1 to 4 hydroxyl groups and with from 4 to 8 carbon atoms; and
     - (iii) a water soluble calcium salt in an amount sufficient to provide from about 18 to 50 millimoles of calcium ion per liter of the composition; and
   - E) water.

2. The liquid detergent composition of claim 1 wherein the enzyme stabilization system comprises (i) borax, (ii) citric acid, and (iii) calcium chloride.

3. The liquid detergent composition of claim 2 wherein the enzyme stabilization system comprises from about 0.5 to about 8% by weight borax, from about 1.5 to about 2.5% by weight citric acid and calcium chloride in an amount sufficient to provide from about 22 to about 36 millimoles of calcium ion per liter of the composition.

4. The liquid detergent composition of claim 1 wherein the enzyme stabilization system comprises from about 0.5 to about 8% by weight borax, from about 1.5 to about 2.5% by weight citric acid and calcium chloride in an amount sufficient to provide from about 22 to about 36 millimoles of calcium ion per liter of the composition.

5. The liquid detergent composition of claim 1 which further comprises a softening effective amount of a clay softening agent.

6. The liquid detergent composition of claim 1 which comprises (A) from about 5 to about 30%, by weight, of a mixture of (a) non-soap anionic surface active compound and (b) nonionic surface active detergent compound at an (a):(b) ratio, by weight, of from about 1:4 to about 10:1.

7. The liquid detergent composition of claim 6 wherein the anionic (a) is an alkyl polyethoxy sulfate wherein the alkyl is from 10 to 18 carbon atoms and which includes from 3 to 11 ethoxy groups, and wherein the nonionic (b) is a mixed ethylene oxide-propylene oxide fatty alcohol condensation product of the formula $$RO(C_3H_6O)_p(C_2H_4O)_qH$$

wherein R is a straight or branched, primary or secondary aliphatic hydrocarbon, of from 6 to 20 carbon atoms, p is a number of from 2 to 8 on average, and q is a number of from 2 to 12 on average.

8. A built aqueous liquid enzyme containing cleaning composition comprising:
   - (A) from about 5 to about 30%, by weight, of at least one surface active detergent compound selected from the group consisting of anionic, nonionic and ampholytic detergent compounds;
   - (B) from about 5 to about 25%, by weight, of a detergency builder comprising a zeolite;
   - (C) from about 0.1 to about 3%, by weight, protease enzyme;
   - (D) an enzyme stabilization system containing:
     - (i) from about 0.5 to about 8%, by weight, of boric acid, boric oxide or alkali metal borate;
     - (ii) from about 1.5 to about 2.5%, by weight, of citric acid; and
     - (iii) a water-soluble calcium salt in an amount sufficient to provide from about 22 to about 36 millimoles of calcium ion per liter of the composition;
   - (E) from about 5 to about 20% by weight of a clay softening agent; and
   - (F) water, and optionally perfume and other adjuvants.

9. A method of laundering stained or soiled fabrics comprising contacting the fabrics with the stabilized enzyme containing liquid detergent composition of claim 1.

* * * * *